US006929566B2

(12) United States Patent
Sano

(10) Patent No.: US 6,929,566 B2
(45) Date of Patent: Aug. 16, 2005

(54) GOLF CLUB HEAD AND METHOD OF MANUFACTURING THE SAME

(75) Inventor: Yoshinori Sano, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/742,877

(22) Filed: Dec. 23, 2003

(65) Prior Publication Data

US 2004/0138001 A1 Jul. 15, 2004

(30) Foreign Application Priority Data

Jan. 15, 2003 (JP) ..... 2003-007489

(51) Int. Cl.[7] ..... A63B 53/04; A63B 53/06; C22C 14/00

(52) U.S. Cl. ..... 473/349; 420/420

(58) Field of Search ..... 473/324, 325, 473/329, 330, 342, 349

(56) References Cited

U.S. PATENT DOCUMENTS 5,026,520 A * 6/1991 Bhowal et al. ..... 148/670
5,244,517 A * 9/1993 Kimura et al. ..... 148/670
5,509,979 A * 4/1996 Kimura ..... 148/421
6,663,501 B2 * 12/2003 Chen ..... 473/324
2004/0035509 A1 * 2/2004 Woodfield ..... 148/671

FOREIGN PATENT DOCUMENTS

JP 8-224327 9/1996
JP 10-179817 7/1998
JP 11077212 A * 3/1999 ..... B21J/1/04
JP 2001-288518 10/2001

* cited by examiner

*Primary Examiner*—Gregory Vidovich
*Assistant Examiner*—Alvin A. Hunter, Jr.
(74) *Attorney, Agent, or Firm*—Birch, Stewart, Kolasch & Birch, LLP

(57) ABSTRACT

A method of manufacturing a golf club head comprises: making a billet of a titanium alloy Ti-6Al-4V by machining an ingot of the titanium alloy; forging the billet into a face plate within a temperature range of from (the beta transformation temperature −150 degrees C.) to (the beta transformation temperature −20 degrees C.); and jointing the face plate and a head main body, whereby the golf club head comprise a face portion for hitting a ball, at least part of which is made of an alpha and beta type titanium alloy Ti-6Al-4V including alpha phase crystal structure whose average grain size is not less than 20 micrometers but less than 70 micrometers.

11 Claims, 3 Drawing Sheets

GOLF CLUB HEAD AND METHOD OF MANUFACTURING THE SAME

This Non-provisional application claims priority under 35 U.S.C. § 119(a) on Patent Application No. 2003-7489 filed in Japan on Jan. 15, 2003, the entire contents of which are hereby incorporated by reference.

BACKGROUND OF THE INVENTION

The present invention relates to a method of manufacturing a golf club head.

In recent years, in order to increase the traveling distance of a ball, various efforts are made on the golf clubs. In the club heads, for example, wood-type club heads in particular, a thin metal material such as titanium alloys is used to form the face portion. This is intended to increase the deflection of the face portion at impact so that the kinetic energy of the club head is transferred to the ball at a minimum loss and the initial velocity of the ball becomes maximum, namely the restitution coefficient is increased.

On the other hand, as the thickness of the face portion decreases, the strength decreases, and the face portion is liable to be broken when a large impact force is exerted thereon. Accordingly, a material having superior impact-resistance is required in this portion.

The inventor therefore, conducted the study of various materials, and found that when a specific titanium alloy, which is a widely used titanium alloy Ti-6Al-4V, is specifically processed, a large impact-resistance as well as a large tensile strength and fatigue strength can be obtained, and has accomplished a method for improving the impact-resistance of titanium alloy Ti-6Al-4V in the club head.

SUMMARY OF THE INVENTION

A primary objective of the present invention is therefore, to provide a golf club head, in which the impact-resistance of the face portion is improved without sacrificing other performance although the thickness of the face portion is decreased to improve rebound performance.

Another objective of the present invention is to provide a method of manufacturing a golf club head by which the impact-resistance of the face portion is improved without sacrificing other performance.

According to one aspect of the present invention, a golf club head comprises a face portion for hitting a ball, at least part of which is made of an alpha and beta type titanium alloy Ti-6Al-4V including alpha phase crystal structure whose average grain size is not less than 20 micrometers but less than 70 micrometers.

According to another aspect of the present invention, a method of manufacturing a golf club head comprises: making a billet of a titanium alloy Ti-6Al-4V by machining an ingot of the titanium alloy; forging the billet into a face plate within a temperature range of from (the beta transformation temperature −150 degrees C.) to (the beta transformation temperature −20 degrees C.); making a head main body; and jointing the face plate and a head main body.

DESCRIPTION OF THE PREFERRED EMBODIMENTS

Figure 1:
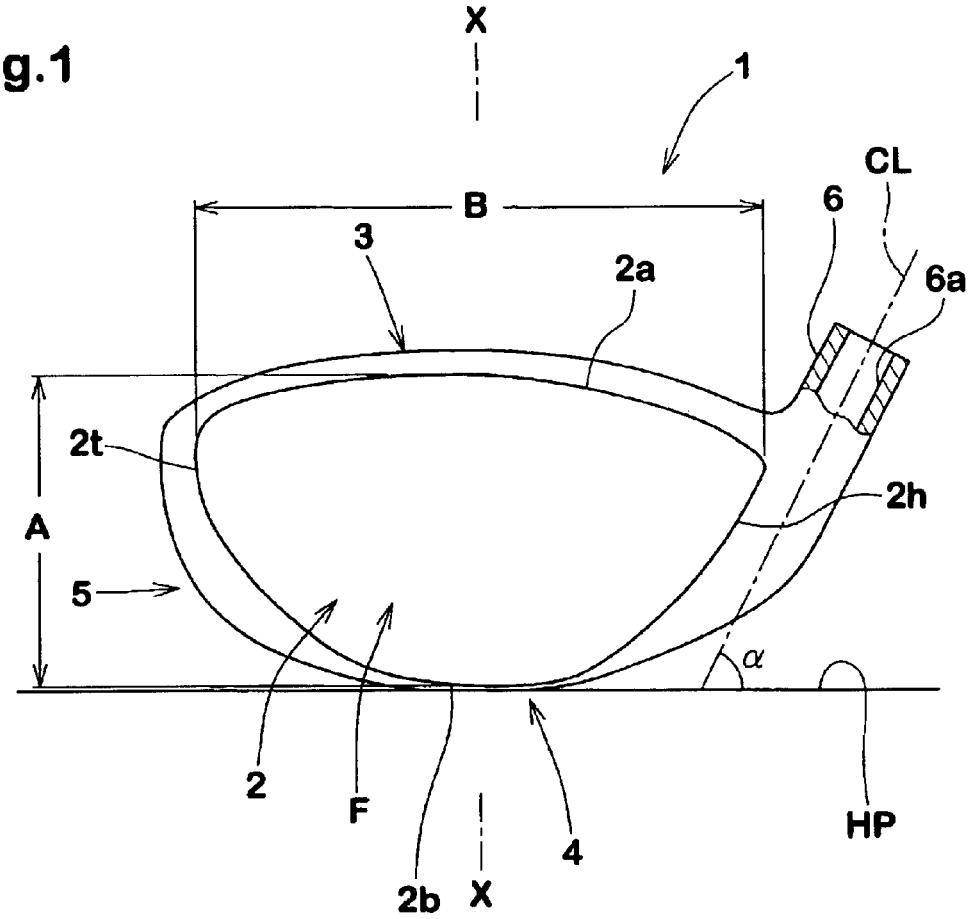
FIG. 1 is a front view of a metal wood-type hollow golf club head according to the present invention.

Embodiments of the present invention will now be described in detail in conjunction with the accompanying drawings.

In the drawings, club head 1 according to the present invention is a hollow metal wood-type head which comprises a face portion 2 of which front face defines a club face F for hitting a ball, a crown portion 3 intersecting the club face F at the upper edge 2*a* thereof, a sole portion 4 intersecting the club face F at the lower edge 2*b* thereof, a side portion 5 between the crown portion 3 and sole portion 4 which extends from a toe-side edge 2*t* to a heel-side edge 2*h* of the club face F through the back face of the club head, and a hosel 6 to be attached to an end of a club shaft (not shown). At the upper end of the hosel 6, a shaft hole 6*a* into which a club shaft is inserted is opened.

Figure 2:
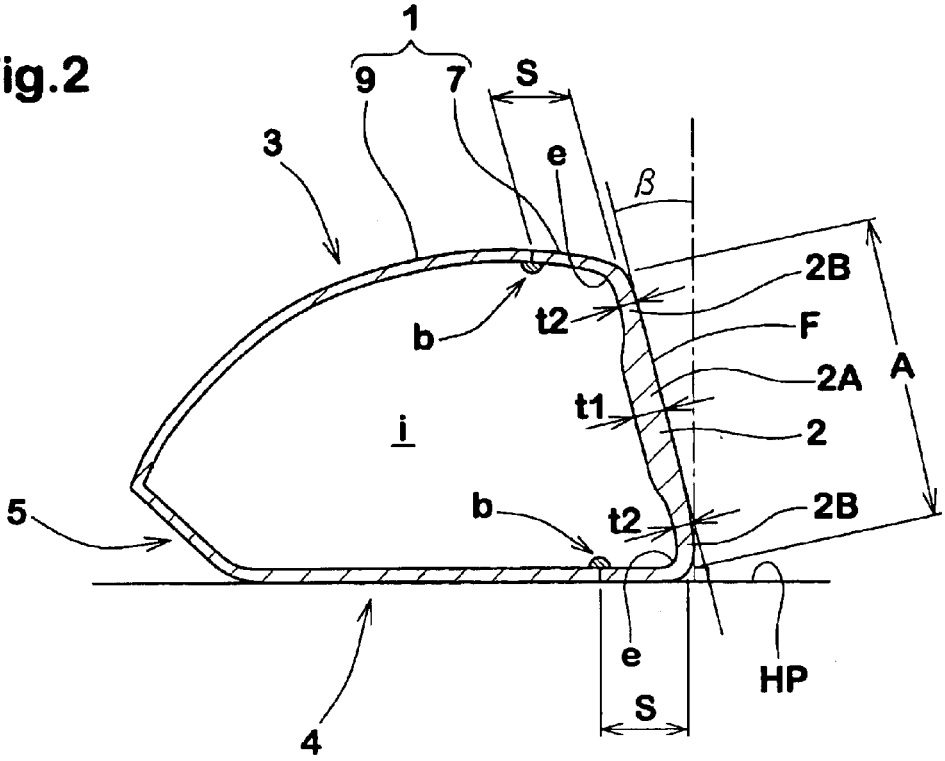
FIG. 2 is a cross sectional view thereof taken along a vertical plane X—X including the center of the club face.

In FIGS. 1 and 2, the club head 1 is in its standard state, namely, the head 1 is set on a horizontal plane HP with its lie angle alpha and real loft angle beta. Incidentally, when the club head 1 alone is set in the standard state, the center line of the shaft hole 6*a* can be used instead of the shaft centre line CL.

The volume of the wood-type club head 1 is preferably not less than 300 cc, more preferably more than 310 cc, but preferably not more than 500 cc, more preferably less than 450 cc. The height (A) of the club face F is preferably not less than 40 mm, more preferably more than 45 mm, still more preferably more than 50 mm, but preferably not more than 75 mm.

In order to improve the rebound performance by increasing the deflection of the club face at impact, it is good to simultaneously increase the club face height (A) and the head volume as above.

The width (B) of the club face F is preferably not less than 90 mm, more preferably more than 95 mm, but preferably not more than 130 mm, more preferably less than 115 mm. Here, the face height (A) is the length measured between the highest end and lowest end of the club face F along a plane inclined at the loft angle beta as shown in FIG. 2.

The face width (B) is the maximum width in the horizontal direction between the extreme ends of the club face F.

If the face height (A) is less than 40 mm and/or the face width (B) is less than 90 mm, the deflection of the face portion 2 becomes small, and it is difficult to improve the rebound performance. If the face height (A) is more than 75 mm and/or the face width (B) is more than 130 mm, due to resultant large deflection, the durability of the face portion is liable to deteriorate.

If the aspect ratio (A/B) of the clubface is too small, it is difficult to obtain an increased deflection. If the ratio (A/B) is too large, as the deflection of the face portion 2 becomes increased, the durability is liable to deteriorates. Therefore, the ratio (A/B) of the face height (A) to the face width (B) is set in a range of from 0.30 to 0.70. When the face height (A) and face width (B) are set in the above-mentioned ranges, it is preferable that the ratio (A/B) is set in a range of from 0.346 to 0.667, namely, about 0.35 to about 0.66.

The club head 1 is composed of a face plate 7 which defines at least a principal major part of the club face F, and a main body 9 to which the face plate 7 is fixed.

Figure 3:
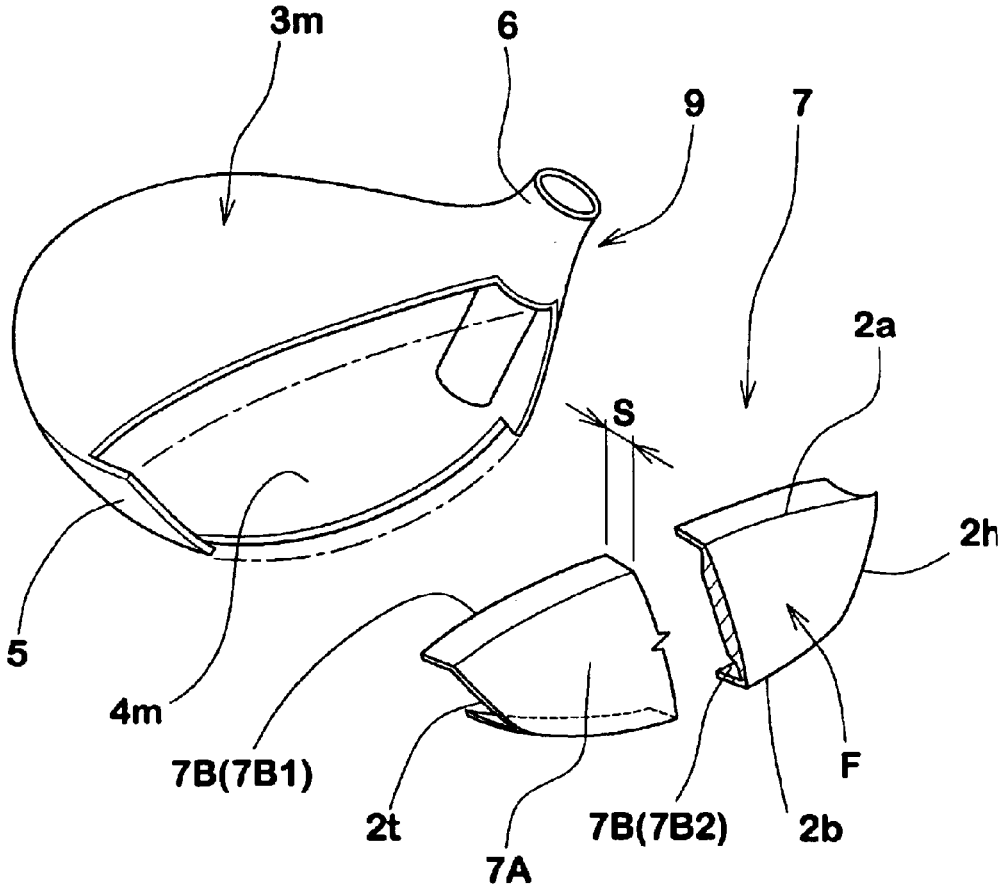
FIG. 3 is an exploded perspective showing an exemplary two-piece structure for the wood-type club head shown in FIG. 1.

FIG. 3 shows a two-piece structure used in this embodiment, which comprises a hollow main body 9 and a face plate 7 attached to the front of the main body 9 to defines the entirety of the face portion 2.

The face plate 7 in this example comprises a main part 7A whose front face defines the club face F, and a turnback 7B extending backwards from the circumferential edge of the club face F by a small length S. It is not always necessary that the turnback 7B is provided along the entire length of the circumferential edge.

In this embodiment, the turnback 7B includes a sole-side turnback 7B2 extending from the lower edge 2*b* to form a front end part of the sole portion 4, and a crown-side turnback 7B1 extending from the upper edge 2*a*, with exception of a part corresponding to the hosel 6, to form a front end part of the crown portion 3. Thus, the face plate 7 has a ⊐-shaped sectional shape in almost any vertical section.

In addition to the turnback 7B1 and 7B2, however, a toe-side turnback extending from the toe-side edge 2*t* and/or a heel-side turnback extending from the heel-side edge 2*h* may be included. Further, as another modification, the turnback 7B may be the crown-side turnback 7B1 only.

As to the main body 9, on the other hand, in order to adapt the turnback 7B, the front edge of the main body 9 around the front opening is set back accordingly. The main body 9 in this example is therefore, composed of the remaining major part 3*m* of the crown portion 3, the remaining major part 4*m* of the sole portion 4, the above-mentioned side portion 5 and the hosel 6, whereby the front is opened. The front opening is closed by the attached face plate 7, and a closed hollow (i) is formed.

The above-mentioned face plate 7 is made of a titanium alloy Ti-6Al-4V.

In this specification, the titanium alloy Ti-6Al-4V means an alloy which is made up of: 5.4 to 6.6 wt % of aluminum; 3.6 to 4.4 wt % of vanadium; and titanium as the remainder thereof. Of course, there is a possibility that unavoidable impurities or very small amount of elements which have no substantial effect on the characteristic features of the alloy are included.

Such a titanium alloy Ti-6Al-4V is able to retain both of alpha phase and beta phase stably at room temperature.

Figure 4:
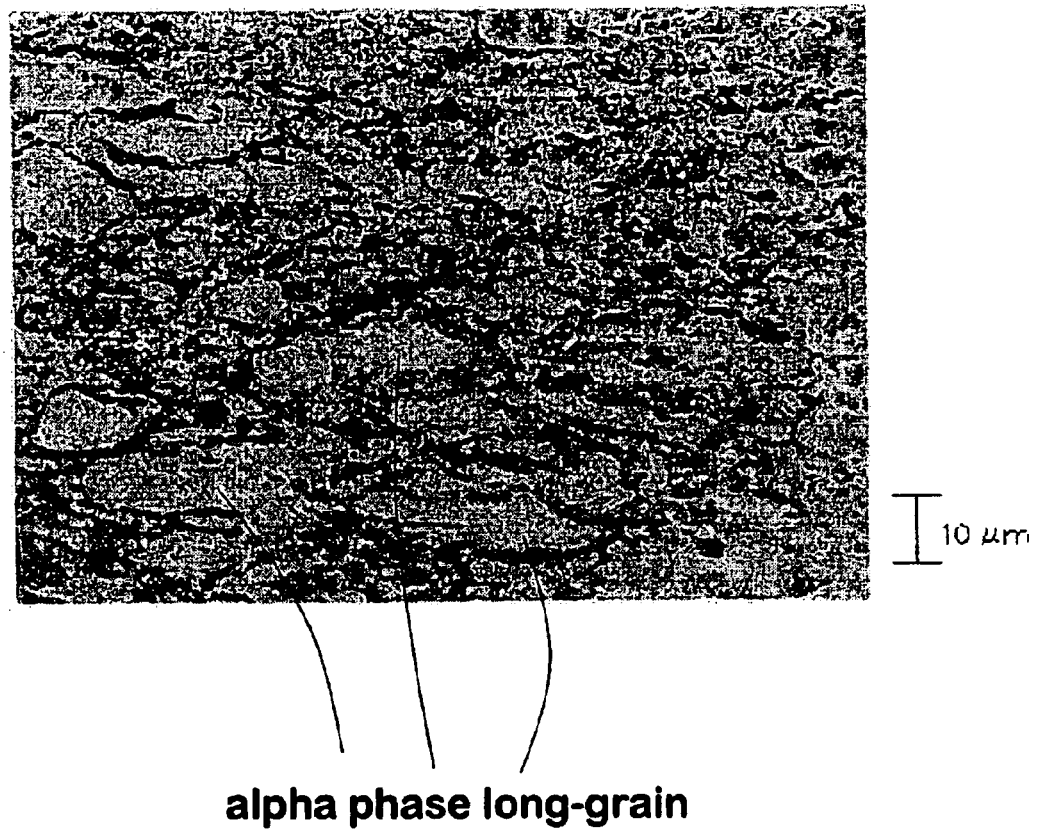
FIG. 4 is a micrograph showing a microstructure of the face portion according to the present invention.

In the finished club head, the titanium alloy Ti-6Al-4V of the face portion has alpha phase and beta phase, and almost all the crystal grains in the alpha phase are long-grain as shown in FIG. 4.

If the average size of the long-grains in the longitudinal direction (max size direction of grain) is less than 20 micrometers, the elongation of the alloy is decreased and as a result, the impact-resistance of the club face is liable to decrease. If the average size is more than 70 micrometers, the tensile strength is decreased, and plastic deformation such as dent is liable to occur in the face portion at impact. Therefore, the average size is set in a range of not less than 20 micrometers, preferably not less than 25 micrometers, but less than 70 micrometers, preferably less than 55 micrometers, more preferably less than 40 micrometers.

In order to provide such relatively large-sized alpha crystal grains in the face portion of the finished club head, in this embodiment, a billet is prepared from an ingot of the titanium alloy by machining without utilizing rolling nor drawing, and the face plate 7 is formed by forging a billet at a temperature between (BTT −(minus) 150 degrees C.) and (BTT −20 degrees C.), wherein BTT is the beta transformation temperature from alpha phase to beta phase of the titanium alloy Ti-6Al-4V which is about 990 degrees C., and the forged face plate 7 is welded to the main body 9. In this embodiment, as for the face plate 7 at least, heat treatment, e.g. solution heat treatment, aging treatment and the like is not made thereon after the face plate 7 is forged and further after the face plate 7 is welded.

Using a vacuum arc furnace or the like, the elements of the titanium alloy are melted, and an ingot of the titanium alloy whose diameter is in the range of from about 100 to about 400 mm is made firstly. At that time the ingot has alpha phase and beta phase. Incidentally, the alpha phase formed in the ingot during cooling process from the melted, fused state of the elements is generally called pro-eutectoid alpha phase. Almost all the crystal grains in the pro-eutectoid alpha phase are long-grain whose average size is not less than 20 but less than 200 micrometers in the longitudinal direction of the long-grain. In this embodiment, the pro-eutectoid alpha phase is retained in the face portion 2 of the finished club head, with keeping the average size of the long-grain within the above-mentioned range.

For this purpose, the billet is formed from the ingot by machining.

In this specification, the "machining" is used against plastic forming and may include cutting, shaving, grinding/polishing. In the machining, when compared with plastic forming, as the shearing force exerted on the material is small, the more pro-eutectoid alpha phase is retained in the billet. For example, the ingot is sliced into a plurality of pieces by a length corresponding to that of the billet, and then each of the sliced pieces is cut into a plurality of billets to be forged.

When the billet is forged into the face plate 7, if the forging temperature is lower than (the beta transformation temperature −150 degrees C.), the workability will be deteriorated because the alloy of the billet is difficult to make a plastic flow. Accordingly, a high-power forging machine is necessitated, and there is a tendency to cause hairline fracture or cracking in the finished part. If the forging temperature is higher than (the beta transformation temperature BTT −20 degrees c), the pro-eutectoid alpha phase is transformed into beta phase and it becomes very difficult to improve the impact-resistance. Therefore, the forging temperature is set in a range between (BTT −150 degrees C.) and (BTT −20 degrees C.), more preferably between (BTT −70 degrees C.) and (BTT −20 degrees C.).

In this specification, the "forging" means a process of heating the billet up to the above-mentioned forging temperature range and beating or pressing the billet into the specific target shape, namely forming the billet into the shape utilizing mainly compressive plastic deformation caused by a large compressive force not a tensile force because the alpha crystal grain having suitable size is liable to be broken up if a large tensile force is exerted thereon. Thus, various types of forging such as die forging (inclusive of flat die, open die, closed die and semiclosed die) is included. But, rolling is not included.

In case of die forging, two-stage forging, namely, preforming and finish forging using a rougher and a finisher, respectively, or three-stage forging including additional intermediate forming between the preforming and finish forging is desirable. In this embodiment, in order to avoid scale, closed die forging is used.

It is important that the alpha crystal grain of the pro-eutectoid alpha phase in the billet keeps the average size within the above-mentioned range until the completion of the club head, thus after the end of the forging.

If the aspect ratio of the crystal grain is too small, the grains are brought into line at closely, and cracks are liable to spread along the alignment lines. Therefore, the fatigue strength has a tendency to decrease. On the other hand, if the aspect ratio is too large, the tensile strength tends to decrease. Thus, it is preferable that the aspect ratio is not less than 1.1, preferably more than 2.0, more preferably more than 3.0, but mot more than 14.0, preferably less than 12.0, more preferably less than 10.0. Here, the aspect ratio of the alpha crystal grain is the ratio (a/b) of the length (a) in the longitudinal direction and the thickness (b) in a direction orthogonal to the longitudinal direction.

On the other hand, the main body 9 may be formed from various materials, but a titanium alloy is preferably used. In this embodiment, the main body 9 is an integral molding of the titanium alloy Ti-6Al-4V which is, for example, formed by lost-wax precision casting process. Also other methods may be used depending on the material used.

The face plate 7 and the main body 9 are welded edge to edge as shown in FIG. 2.

Even if a rigid weld bead (b) is formed, as the turnback 7B exists, the weld bead (b) is away from the circumferential edge of the club face F, and not only the rebound performance but also the working property in welding can be improved.

Further, by the turnback 7B, the heat during welding is dispersed and cooled at the face portion, and the adverse effect on the crystal structure to transform alpha phase into beta phase can be avoided. In this view, the length S of the turnback 7B measured in the back and forth direction from the circumferential edge (2*a*, 2*b*, 2*t*, 2*h*) to the rear edge of the turnback 7B is preferably set in the range of from 5 to 20 mm, more preferably 5 to 15 mm.

In order to achieve an increased deflection of the face portion 2, the maximum thickness t1 of the face portion 2 is preferably limited in the range of from 2.0 to 2.9 mm, more preferably 2.1 to 2.9 mm, still more preferably 2.3 to 2.9 mm.

In this embodiment, in order to further increase the deflection of the face portion 2 at impact without decreasing the durability and strength, the face portion 2 is provided with a thinner peripheral region 2B having a minimum thickness t2 encircling a thicker central region 2A having the thickness t1 as shown in FIG. 2. The central region 2A includes a sweet spot of the club face and has a shape which is, roughly speaking, an oval similar to the club face long from side to side.

The minimum thickness t2 is preferably set in the range of from 1.8 to 2.7 mm, more preferably 1.3 to 2.4 mm.

Preferably, the difference (t1–t2) is in the range of from 0.1 to 1.9 mm, more preferably 0.2 to 1.5 mm. Between the central thick region 2A and the peripheral thinner region 2B, the thickness of the face portion is gradually or continuously changed.

In addition, if the pro-eutectoid alpha phase in the billet is found to be smaller in the crystal grain size than the lower limit of the above-mentioned range, it is possible to grow the alpha crystal grain over the lower limitation to a considerable degree by keeping the billet at the forging temperature for a long time of 4 to 6 hours. Thereafter, the forging is made.

Comparison Tests

Golf club heads for metal wood having the identical structure shown in FIGS. 1, 2 and 3 were made and the heads were tested for the rebound performance and the impact-resistance of the face portion. Also the Vickers hardness and the average length of alpha crystal grain were measured.

In each of the heads, the main body was a casting of Ti-6Al-4V. The face plate was formed from a billet by two-stage forging, namely, preforming and finish forging using a rougher and a finisher. In the preforming, the billet was formed into a ⊐-shaped cross sectional shape after the billet was heated up to 930 degrees C. and held at the temperature for fifteen minutes.

In the finish forging, the billet was again heated to 930 degrees C. and held for five minutes, and then the billet was formed into the final shape of the face plate shown in FIG. 3.

The maximum thickness t1 of the central thick region was 2.5 mm, and the minimum thickness t2 of the peripheral thinner region was 2.1 mm. The face height (A) was 60 mm, the face width (B) was 100 mm, and the turnback length S was 10 mm.

In Ex.1–Ex.4, the billets were obtained from a 100 mm dia. ingot of the titanium alloy Ti-6Al-4V as a round bar by machining (cutting). In Ref.1 and Ref.2, the billets were obtained as a 20 mm dia. round bar by drawing an ingot (100 mm, 150 mm diameter) of the titanium alloy Ti-6Al-4V after heating it up to a temperature higher than the beta transformation temperature.

Average Length of Alpha Crystal Grain

From the face portion, a sample (25 mm length×10 mm width×2.5 mm thick) was cut out and the cut surface (perpendicular to the club face) was polished and then etched. Thereafter, the microstructure of the cut surface was examined under an optical microscope with a magnification of 500, and the average length in the longitudinal direction for the first to fifteenth largest grains was obtained.

Vickers Hardness

Using a micro hardness tester "HMV-2000" manufactured by Shimadzu corporation, the Vickers hardness of the club face was measured. The load was 50 gf and the load duration time for which the load of 50 gf was applied was ten seconds. The measurement was made at five positions in a circular region of 5 mm radius centered on the centroid of the club face. Their average value is shown in Table 1.

Impact-resistance Test

Two-piece balls were hit 100 times against the face portion of the immovable club head at a ball speed of 55 m/s and then the resultant dent was measured. The smaller the value, the better the impact-resistance.

Rebound Performance Test

According to the "Procedure for Measuring the Velocity Ratio of a Club Head for Conformance to Rule 4-1e, Appendix II, Revision 2 (Feb. 8, 1999), United States Golf Association", the restitution coefficient (e) of each club head was obtained. The results are shown in Table 1. The larger the value, the better the rebound performance.

Durability Test

The golf club heads were attached to identical shafts to make wood clubs. The club was mounted on a swing robot and repeatedly struck the balls at a head speed of 50 m/s while counting up the number of times until the face plate was broken. The results are shown in Table 1, wherein "A" indicates the counting was reached to 5000 without broken, "B" indicates the counting was less than 5000 but not less than 3000, and "C" indicates the counting was less than 3000.

Feeling Test

Based on the hit sound and hit feel, ten golfers whose handicaps ranged from 0 to 5 evaluated the test clubs after hitting the two-piece balls ten times per each club. The results are shown in Table 1, wherein "A" indicates that seven or more persons had a good feel, "B" indicates that four to six persons had a good feel, and "C" indicates that not more than three persons had a good feel.

TABLE 1

| | Head | | | | | |
|---|---|---|---|---|---|---|
| | Ex. 1 | Ex. 2 | Ex. 3 | Ex. 4 | Ref. 1 | Ref. 2 |
| Ingod | | | | | | |
| Diameter (mm) | 100 | 100 | 100 | 100 | 100 | 150 |
| Method | cutting | cutting | cutting | cutting | drawing | drawing |
| Billet | | | | | | |
| Diameter (mm) | 20 | 80 | 50 | 35 | 20 | 20 |
| Pro-eutectoid alpha phase alpha crystal grain | | | | | | |
| Average length (micrometer) | 65 | 52 | 30 | 25 | 12 | 81 |
| Vickers hardness (HV) | 327 | 326 | 330 | 322 | 324 | 329 |
| Impact-resistance (dent in mm) | 0.05 | 0.05 | 0.03 | 0.02 | broken at 90 hits | 0.1 |
| Rebound performance | 0.841 | 0.84 | 0.84 | 0.839 | 0.839 | 0.84 |
| Strength | A | A | A | A | B | A |
| Feel | A | A | A | A | A | A |

It was confirmed from the test results that the impact-resistance can be improved without sacrificing other improtant performance, e.g. such as rebound performance, strength, feel and the like.

The present invention is suitably applied to a metal wood-type hollow club head, but it is also possible to apply to another type of club head such as iron-type and patter-type.

What is claimed is:

1. A method of manufacturing a golf club head comprising a face portion, at least part of which is made of a face plate of an alpha and beta type titanium alloy Ti-6Al-4V, the method comprising preparing an ingot of the titanium alloy Ti-6Al-4V formed by melting elements of the titanium alloy and cooling the melted and fused elements so that the ingot has alpha phase crystal structure and beta phase crystal structure and the alpha phase crystal structure is long-grains having an average grain size of not less than 20 but less than 200 micrometers in the longitudinal direction of the long-grain, making a billet of the titanium alloy Ti-6Al-4V by machining the ingot of the titanium alloy, said machining including at least one of cutting, shaving, grinding and polishing, but excluding plastic forming, forging the billet into a face plate within a temperature range of from (the beta transformation temperature −150 degrees C.) to (the beta transformation temperature −20 degrees C.), utilizing mainly compressive plastic deformation caused by a compressive force, so that the average grain size of the long-grains is maintained in a range of not less than 20 but less than 55 micrometers after forged and the long-grain has an aspect ratio of not less than 1.1, but not more than 14.0, and jointing the face plate and a head main body without a heat treatment to the face plate by which the average grain size of the long-grains is changed, whereby the average grain size is maintained within said range of not less than 20 but less than 55 micrometers in the face portion.

2. The method according to claim 1, wherein the face plate comprises a main part whose front face defines the club face, and a turnback extending backwards from the edge of the club face by a small depth in the range of from 5 to 20 mm.

3. The method according to claim 2, wherein said turnback includes a sole-side turnback extending from the lower edge of the club face, and a crown-side turnback extending from the upper edge of the club face.

4. The method according to claim 3, wherein in the process of jointing the face plate and head main body, the face plate is welded to the head main body.

5. The method according to claim 1, which further comprises making the head main body by casting a titanium alloy.

6. The method according to claim 1, wherein said temperature range is between (the beta transformation temperature −70 degrees C.) and (the beta transformation temperature −20 degrees C.).

7. The method according to claim 1, wherein said aspect ratio is more than 2.0.

8. The method according to claim 1, wherein said aspect ratio is more than 3.0.

9. The method according to claim 1, wherein said aspect ratio is less than 12.0.

10. The method according to claim 1, wherein said aspect ratio is less than 10.0.

11. The method according to claim 1, wherein the titanium alloy Ti-6Al-4V includes 5.4 to 6.6 wt % of aluminum and 3.6 to 4.4 wt % of vanadium.

* * * * *